US008215763B2

(12) United States Patent
Niimi

(10) Patent No.: US 8,215,763 B2
(45) Date of Patent: Jul. 10, 2012

(54) PRINTING APPARATUS

(75) Inventor: Akiko Niimi, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1035 days.

(21) Appl. No.: 12/071,032

(22) Filed: Feb. 14, 2008

(65) Prior Publication Data

US 2008/0238978 A1 Oct. 2, 2008

(30) Foreign Application Priority Data

Mar. 29, 2007 (JP) ..... 2007-086750

(51) Int. Cl.
*B41J 29/38* (2006.01)
*B41J 2/01* (2006.01)

(52) U.S. Cl. ..... 347/104; 347/16; 347/101

(58) Field of Classification Search ..... None
See application file for complete search history.

(56) References Cited

U.S. PATENT DOCUMENTS

| | | | | |
|---|---|---|---|---|
| 2002/0060728 | A1 | 5/2002 | Koizumi et al. | |
| 2004/0179081 | A1* | 9/2004 | Nimi et al. | 347/104 |
| 2004/0252173 | A1 | 12/2004 | Ben-Zur et al. | |
| 2005/0179708 | A1* | 8/2005 | Ben-Zur | 347/2 |
| 2006/0152568 | A1 | 7/2006 | Niimi et al. | |
| 2006/0203069 | A1 | 9/2006 | Niimi et al. | |
| 2007/0057995 | A1 | 3/2007 | Kim | |
| 2007/0103529 | A1 | 5/2007 | Pearl et al. | |
| 2007/0104899 | A1 | 5/2007 | Pearl et al. | |
| 2008/0012884 | A1 | 1/2008 | Ben-Zur et al. | |

FOREIGN PATENT DOCUMENTS

| | | |
|---|---|---|
| EP | 0 835 761 A2 | 4/1998 |
| JP | A-2002-36644 | 2/2002 |
| JP | A-2002-154247 | 5/2002 |
| JP | A-2004-284305 | 10/2004 |
| WO | WO 2005/076730 A2 | 8/2005 |

OTHER PUBLICATIONS

Jun. 14, 2011 Office Action issued in Japanese Patent Application No. 2007-086750 (with English-language translation).

* cited by examiner

*Primary Examiner* — Matthew Luu
*Assistant Examiner* — Kendrick Liu
(74) *Attorney, Agent, or Firm* — Oliff & Berridge, PLC

(57) ABSTRACT

A printing apparatus capable of forming an image on a recording medium is provided. The printing apparatus includes a recording head to eject ink onto the recording medium, a recording head controller to control movement of the recording head according to printing data, which represents the image to be formed on the recording medium, a carriage to carry the recording head in a main scanning direction relative to the recording medium, a plurality of platens, each of which has a holding surface to hold the recording medium thereon and is movable respectively in an auxiliary direction, which is perpendicular to the main scanning direction, and a plurality of drive mechanisms, each of which drives one of the platens in the auxiliary direction. The plurality of platens can be moved synchronously with one another.

14 Claims, 14 Drawing Sheets

FIG. 7
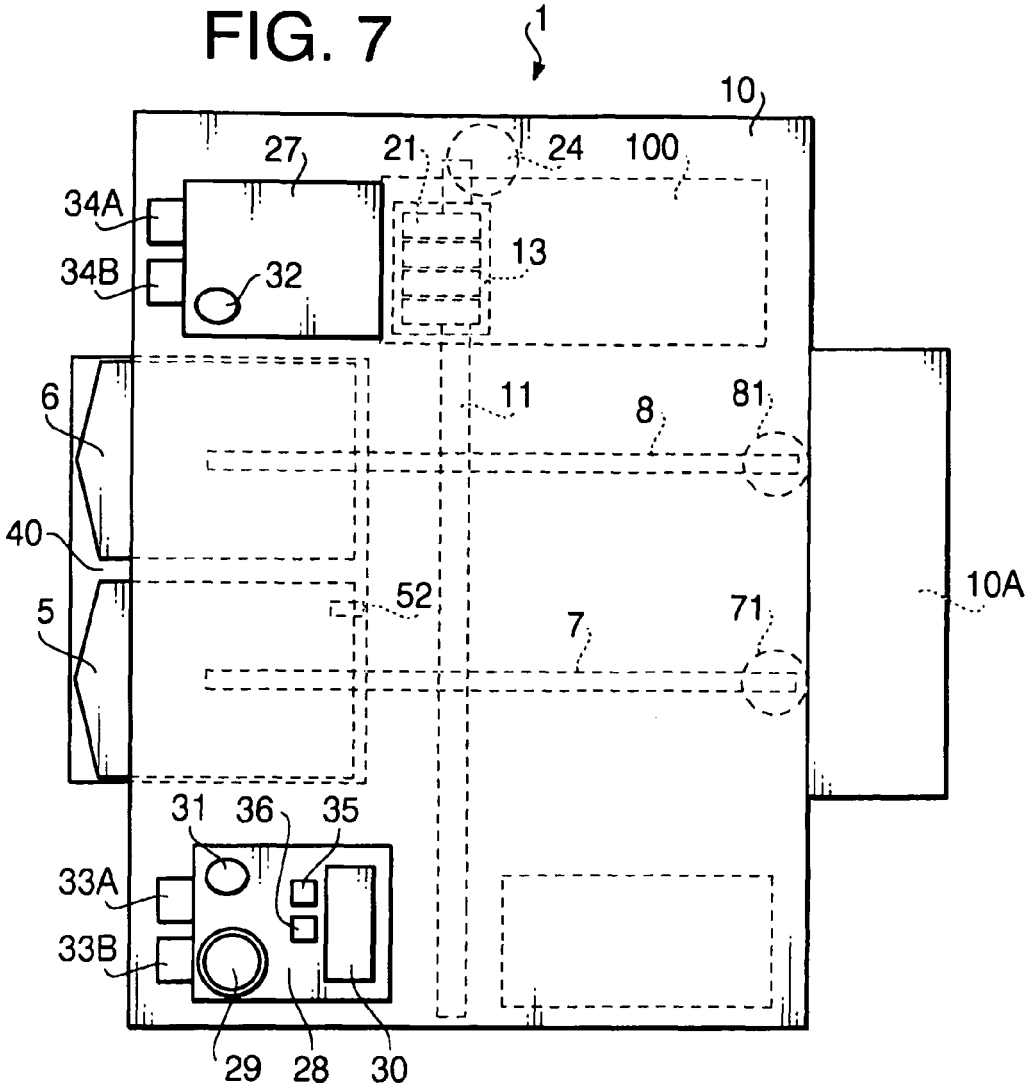
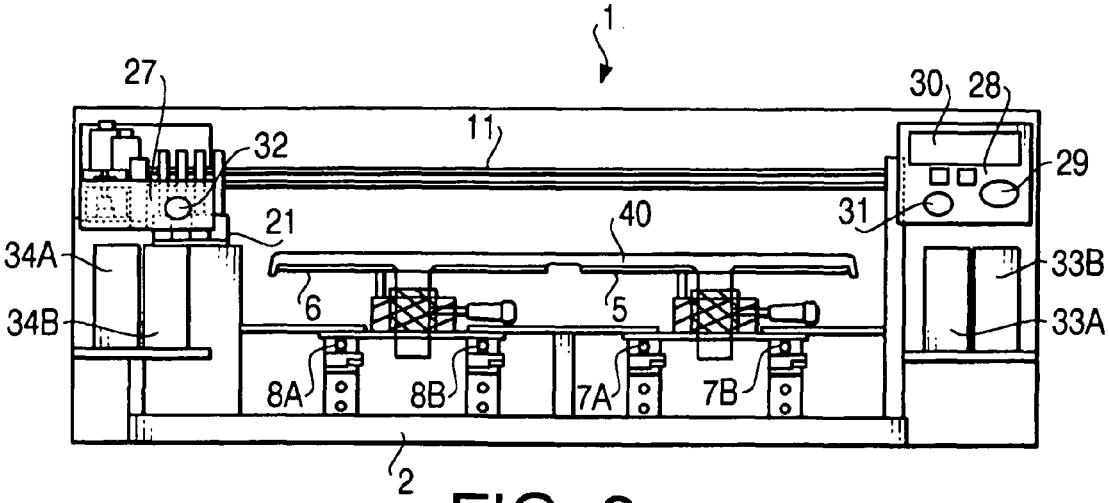
FIG. 8

PRINTING APPARATUS

CROSS REFERENCE TO RELATED APPLICATION

This application claims priority from Japanese Patent Application NO. 2007-086750, filed on Mar. 29, 2007, the entire subject matter of which is incorporated herein by reference.

BACKGROUND

1. Technical Field

An aspect of the present invention relates to a printing apparatus, more specifically, a printing apparatus having a plurality of supporting means to support a recording medium thereon in the printing apparatus.

2. Related Art

Conventionally, a printing apparatus having an inkjet head from which inks are ejected onto a recording medium has been known. Such a printing apparatus is generally provided with a platen to hold the recording medium in position in the printing apparatus, and a size of a printable area on a surface of the recording medium depends on a size of the platen itself. Meanwhile, a printing apparatus having a plurality of platens has been suggested (e.g., United States Patent Application Publication No. US 2005/0179708 A1.) In the printing apparatus disclosed in the publication, the plurality of platens are provided to hold a plurality of pieces of recording medium in order to print images on the recording media in shorter lead time. According to the publication, each piece of the recording media is supported by one of the platens arranged on a same plane (FIGS. 7B and 7C) so that the images can be continuously printed on the recording media by the same inkjet head.

In the above printing apparatus, although the lead time to print images on the plurality of pieces of recording medium may be shortened with the plurality of platens, a printable area in each recording medium is still fixed and limited to the size of the platens. When it is desired that an image larger than the size of the platen is printed on paper, for example, the image can be divided into a plurality of pieces, and each piece can be printed on a sheet of paper which is in a suitable size for one of the platens and patched into a piece thereafter. However, when it is desired that the image larger than the size of the platen to be printed on fabric, for example, alignment of each piece of the printed fabric has been difficult due to stretches, shrinks, and deformation of the fabric. Therefore, the divisional printing to achieve a larger printed image has been substantially inapplicable to fabric. Moreover, when the recording medium is a ready-sewn cloth such as a T-shirt, relocating the cloth in an intended printing position in the printing apparatus in order to achieve the larger printed image is difficult, because various parts of the cloth such as sleeves and seams may interfere with a printing unit (e.g., a print head) of the printing apparatus.

SUMMARY

In view of the above, the present invention is advantageous in that a printing apparatus having a plurality of media-holders and capable of printing a larger image is provided.

According to an aspect of the invention, there is provided a printing apparatus capable of forming an image on a recording medium, having a recording head to eject ink onto the recording medium, a recording head controller to control movement of the recording head according to printing data, which represents the image to be formed on the recording medium, a carriage to carry the recording head in a main scanning direction relative to the recording medium, a plurality of platens, each of which has a holding surface to hold the recording medium thereon and is movable respectively in an auxiliary direction, which is perpendicular to the main scanning direction, and a plurality of drive mechanisms, each of which drives one of the platens in the auxiliary direction. The plurality of platens can be moved synchronously with one another.

With the printing apparatus according to the above configuration, a printable area in which the image is formed can be extended with the plurality of platens synchronously moved.

BRIEF DESCRIPTION OF THE ACCOMPANYING DRAWINGS

FIG. 7 is a top plane view of the inkjet printer with the extensible platen placed over a first platen and a second platen according to the first embodiment of the present invention.

FIG. 8 is a front view of the inkjet printer with the extensible platen placed over the first platen and the second platen according to the first embodiment of the present invention.

DETAILED DESCRIPTION

Hereinafter, embodiments according to aspects of the present invention will be described with reference to the accompanying drawings.

Figure 1:
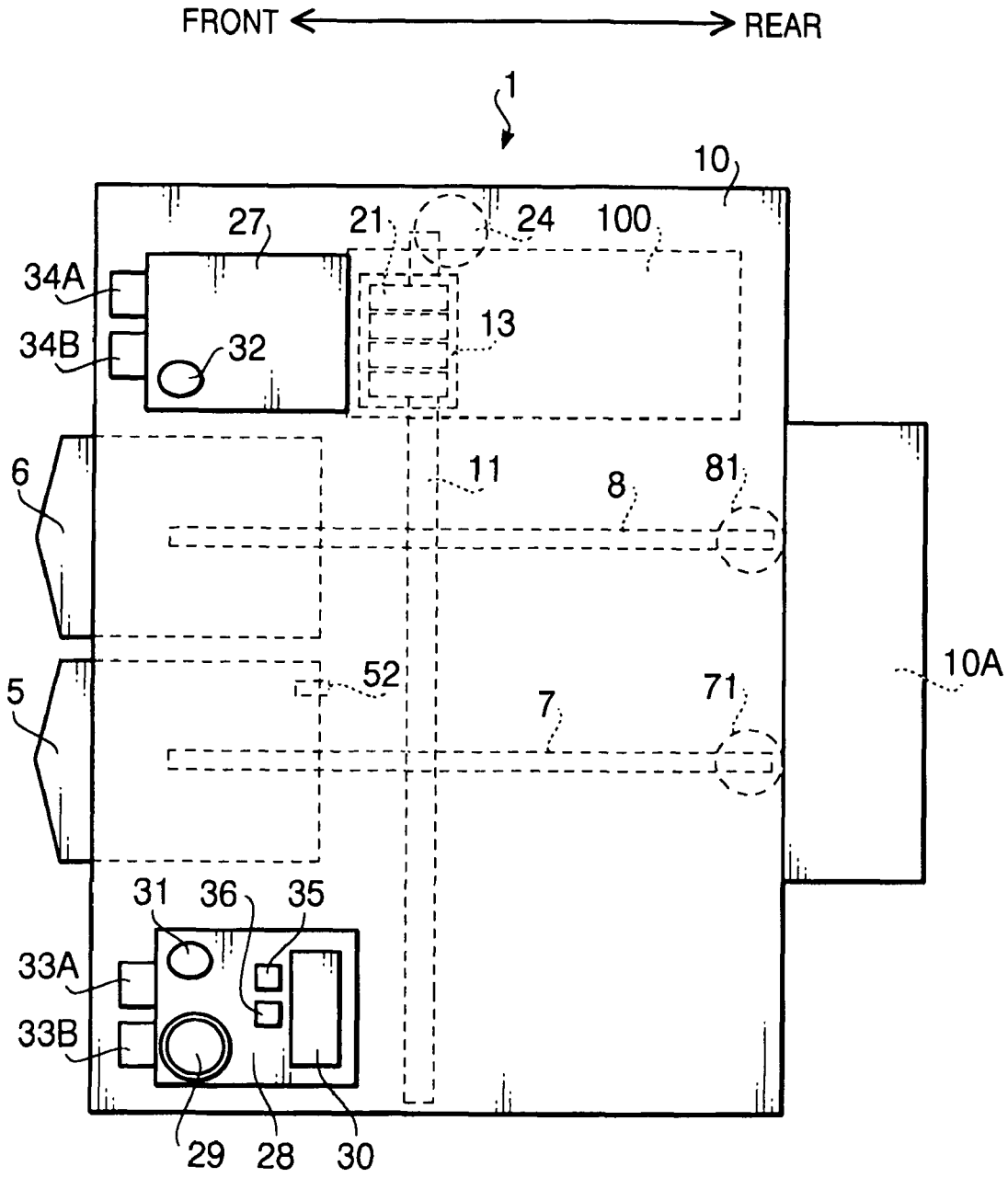
FIG. 1 is a top plane view of an inkjet printer according to a first embodiment of the present invention.
Figure 2:
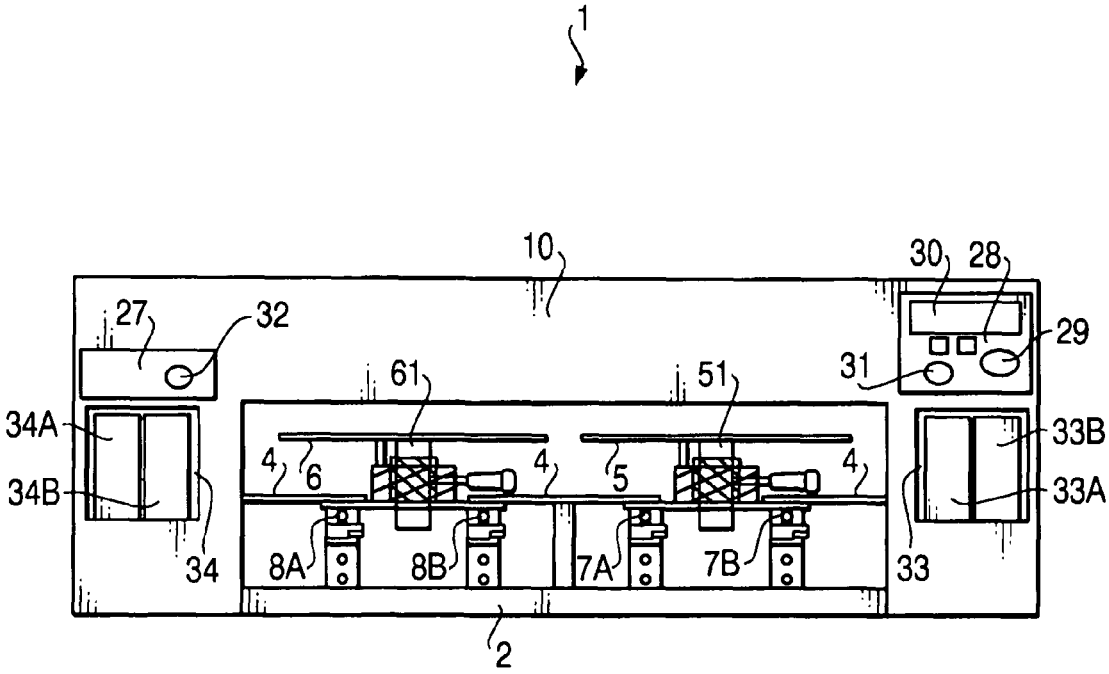
FIG. 2 is a front view of the inkjet printer according to the first embodiment of the present invention.
Figure 3:
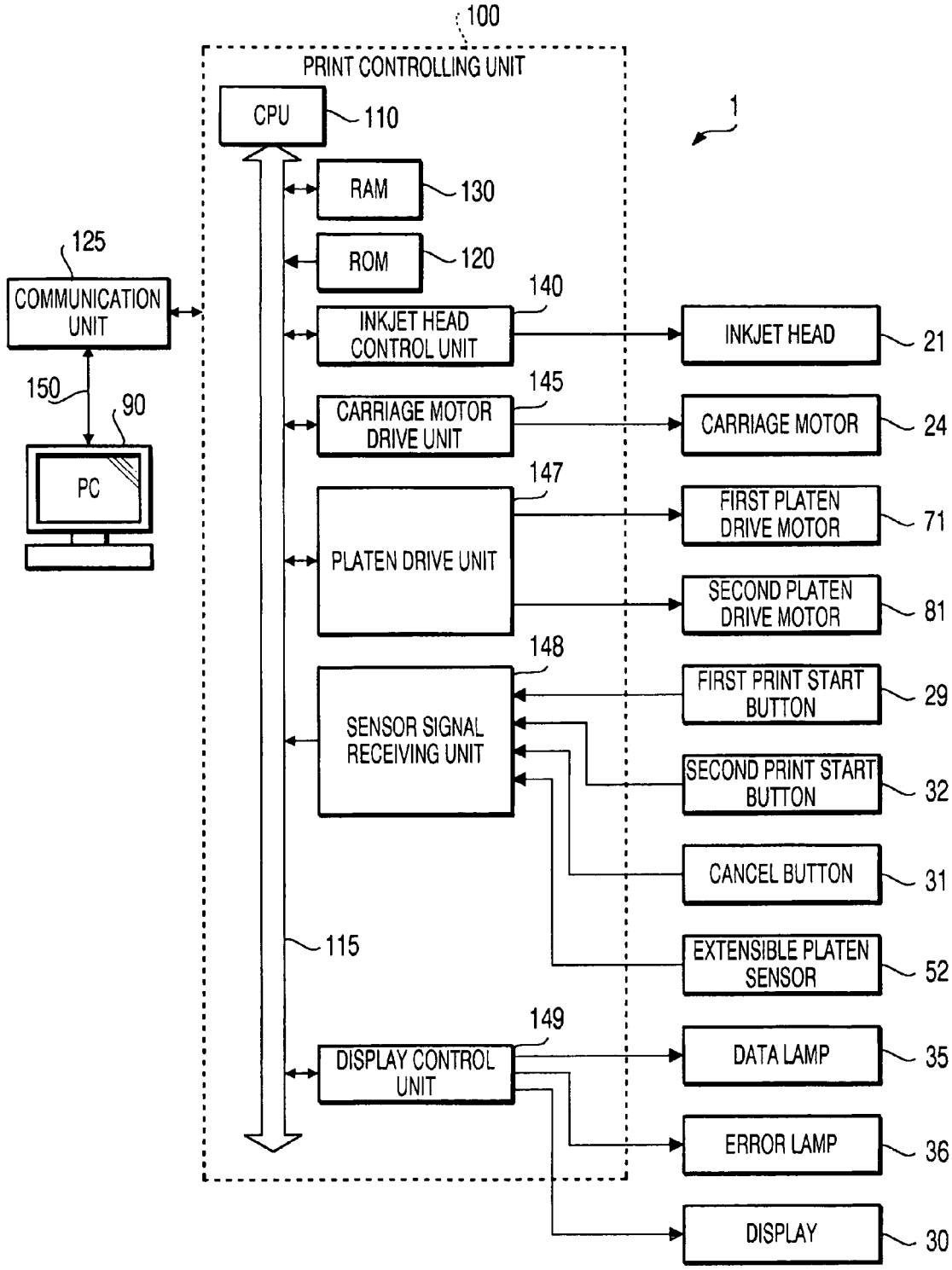
FIG. 3 is a block diagram to illustrate an electrical configuration of the inkjet printer according to the first embodiment of the present invention.

An inkjet printer 1 according to an embodiment of the present invention will be described with reference to FIGS. 1 through 3. FIG. 1 is a top plane view of the inkjet printer 1 according to the embodiment of the present invention. FIG. 2 is a front view of the inkjet printer 1 according to the embodiment of the present invention. FIG. 3 is a block diagram to illustrate an electrical configuration of the inkjet printer 1 according to the embodiment of the present invention.

The inkjet printer 1 according to the present embodiment is a known inkjet printer having an inkjet head 21, from which inks are ejected onto a recording medium. The recording medium in the present embodiment is fabric, more specifically a T-shirt, and an image according to image data inputted in the inkjet printer 1 from an external data processing apparatus is formed on the T-shirt. As shown in FIGS. 1 and 2, the inkjet printer 1 is provided with a base 2 at a bottom thereof and a casing 10 to cover an entire configuration of the inkjet printer 1. Further, the inkjet printer 1 is provided with a rear casing 10A at a rear end thereof.

In the present embodiment, a left-hand side which appears in FIG. 1 is the front side of the inkjet printer 1, and an upper side in FIG. 1 and a left-hand side in FIG. 2 correspond to the left end of the inkjet printer 1. Accordingly, a lower side in FIG. 1 and a right-hand side in FIG. 2 correspond to the right end of the inkjet printer 1. In addition, a direction, in which the inkjet head 21 mounted on a carriage 13 is reciprocated, corresponds to a main scanning direction (i.e., a vertical direction in FIG. 1) of the inkjet head 21.

In side the casing 10, the inkjet printer 1 is provided with a known inkjet printing mechanism, which includes the inkjet head 21, the carriage 13, and a guide rail 11. The guide rail 11 is arranged in parallel with the main scanning direction to guide the carriage 13 with the inkjet head 21 there-along. Further, a carriage motor 24, a pulley (not shown), and a carriage belt (not shown) are provided. The carriage motor 24 is in vicinity to one end (an upper end in FIG. 1 in the present embodiment) of the guide rail 11, and the pulley is in vicinity to the other end (a lower end in FIG. 1). The carriage belt is provided to connect the carriage motor 24 and the pulley. The carriage belt is fixed to a rear side of the carriage 13 so that the carriage 13 can be reciprocated along the guide rail 11 as the carriage belt is driven by the carriage motor 24. In addition, the inkjet printer 1 is provided with a maintenance unit (not shown) including a capping mechanism, a wiper mechanism, and a purging mechanism for the inkjet head on one of the ends of the guide rail 11.

Next, platens of the inkjet printer 1 according to the present embodiment to hold the recording medium will de described. The inkjet printer 1 is provided with a pair of platens, a first platen 5 and a second platen 6, which are identical to each other. The first platen 5 and the second platen 6 are movable in parallel with an auxiliary scanning direction, which is substantially perpendicular to the main scanning direction of the inkjet head 21 (i.e., a horizontal direction in FIG. 1).

In order to drive the platens 5, 6, in the auxiliary direction respectively, the inkjet printer 1 is provided with a first drive mechanism 7 and a second drive mechanism 8, which are arranged in parallel with each other. The first drive mechanism 7 is to drive the first platen 5 and includes guide rails 7A, 7B (see FIG. 2) and a first platen drive motor 71. The first platen drive motor 71, which is a stepping motor in the present embodiment, is arranged on one end (a right-hand end in FIG. 1) of each of the guide rails 7A, 7B. As the first platen drive motor 71 is activated, the first platen 5 is reciprocated in the auxiliary direction along the guide rails 7A, 7B. As shown in FIG. 1, the first platen drive motor 71 is arranged in vicinity to a rear end (the right-hand end in FIG. 1) in the casing 10. Similarly, the second drive mechanism 8 is provided to drive the second platen 6 and includes guide rails 8A, 8B (see FIG. 2) and a second platen drive motor 81, which is a stepping motor. The second platen 6 is reciprocated in the auxiliary direction along the guide rails 8A, 8B as the second platen drive motor 81 is activated. The second platen drive motor 81 is arranged in vicinity to the rear end (the right-hand end in FIG. 1) in the casing 10.

Each of the first platen 5 and the second platen 6 is formed to have a pentagonal shape in a plane view. More specifically, a front end of each platen is formed in an obtuse V-like shape protruding toward the front of the inkjet printer 1 so that the recording medium (i.e., a T-shirt in the present embodiment) can be placed horizontally over a top surface of the platen.

As shown in FIG. 2, trays 4 having surfaces which are substantially parallel with the top surfaces of the first and the second platens 5, 6 are provided at positions below the first and the second platens 5, 6. The trays 4 are provided to receive overhanging portions of the recording medium such as sleeves of the T-shirt, which are not held by the platens 5, 6, so that the trays 4 can prevent the overhanging portions from interfering the base 2 when the T-shirt is installed on the first platen 5 and the second platen 6.

The inkjet printer 1 is provided with an ink cartridge storage unit 33, in which ink cartridges 33A, 33B are stored, on the right-hand side in the casing 10, as shown in FIG. 2. Each of the ink cartridges 34A, 34B, containing CMYK (cyan, magenta, yellow, and black) inks, is connected to the inkjet head 21 through an ink supplying tube (not shown).

As shown in FIGS. 1 and 2, the inkjet printer 1 is further provided with an operation panel 28 on the right-hand side of the front thereof. The operation panel 28 includes a plurality of operation buttons, through which a user's operations are inputted, such as a first print start button 29 to instruct printing and a cancel button 31 to instruct cancellation of the printing instruction. Further, the operation panel 28 includes a display 30 (an LCD (liquid crystal display) in the present embodiment) to display various information, a data lamp 36 to indicate reception of data, and an error lamp 36 to indicate an operation error. The ink cartridge storage unit 33 is arranged below the operation panel 28.

As shown in FIGS. 1 and 2, the inkjet printer 1 is further provided with an operation panel 27 on the left-hand side of the front thereof. The operation panel 27 includes a second print start button 32 to instruct printing. The ink cartridge storage unit 34 is arranged below the operation panel 27.

Next, referring to FIG. 3, an electrical configuration of the inkjet printer 1 according to the present embodiment will be described. FIG. 3 is a block diagram to illustrate the electrical configuration of the inkjet printer 1 according to the embodiment of the present invention. The inkjet printer 1 is provided with a print controlling unit 100, including a CPU 110, a ROM 120, a RAM 130, an inkjet head control unit 140, a carriage motor drive unit 145, a platen drive unit 147, a sensor signal receiving unit 148, and a display control unit 149, which are connected with one another through a bus 115. The CPU 110 controls entire operations of the inkjet printer 1. The ROM 120 stores various controlling programs to be executed by the CPU 110. The RAM 130 temporarily stores various data. The inkjet head control unit 140 controls activation/deactivation of piezoelectric actuators, which are provided in each channel in the inkjet head 21. The carriage motor drive unit 145 controls movement of the carriage motor 24. The platen drive unit 147 controls activation of the first platen drive motor 71 and the second platen drive motor 81. The sensor signal receiving unit 148 receives signals from the first print start button 29, the second print start button 32, the cancel button 31, and an extensible platen sensor 52, which will be described later. The display control unit 149 controls the data lamp 35, the error lamp 36, and the display 30. Further, the inkjet printer 1 is provided with a communication unit 125, which connects the inkjet printer 1 with an external PC (personal computer 90) through a USB (universal serial bus) 150. Optionally, the connection between the inkjet printer 1 and the external PC may be provided through a parallel communication interface.

Figure 4:
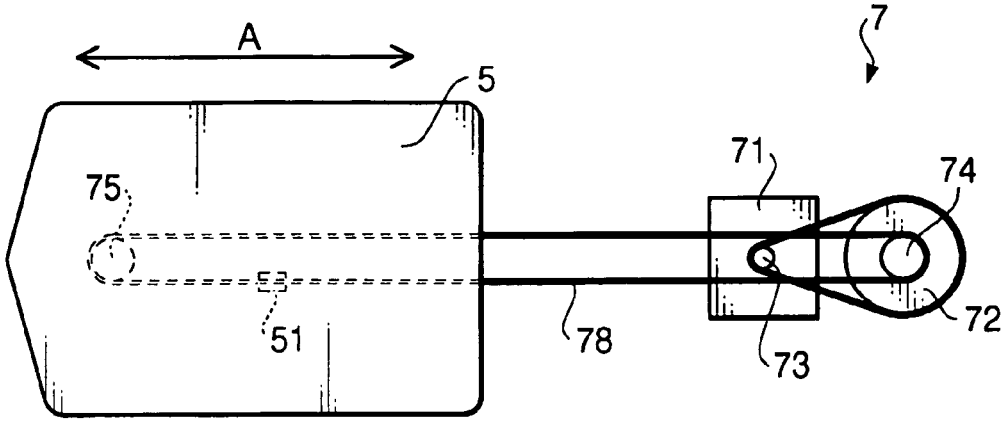
FIG. 4 is an illustrative top view of a first drive mechanism according to the first embodiment of the present invention.
Figure 5:
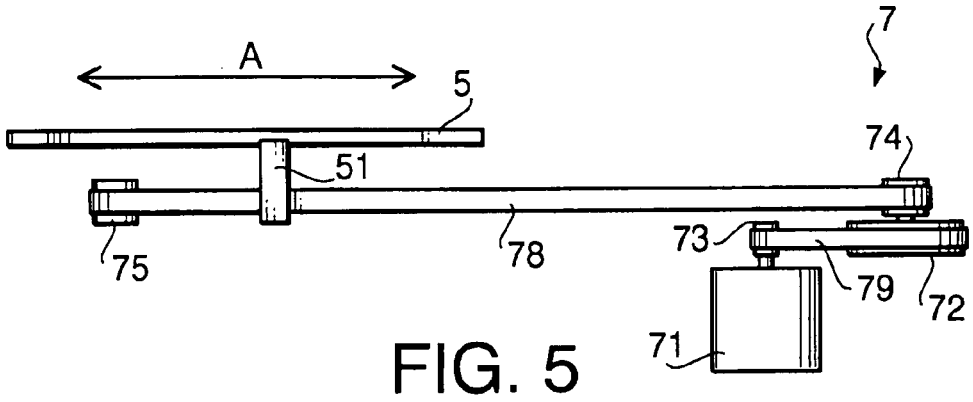
FIG. 5 is an illustrative side view of the first drive mechanism according to the first embodiment of the present invention.

Next, referring to FIGS. 4 and 5, the first drive mechanism 7 to drive the first platen 5 will be described. FIG. 4 is an illustrative top view of the first drive mechanism 7 according to the embodiment of the present invention. FIG. 5 is an illustrative side view of the first drive mechanism according to the embodiment of the present invention. The left-hand side which appears in FIGS. 4 and 5 corresponds to the front of the inkjet printer 1, and the right-hand side which appears in FIGS. 4 and 5 corresponds to the rear of the inkjet printer 1.

The first drive mechanism 7 is provided with a motor pulley 73, a greater pulley 72, and a motor belt 79, and the motor belt 79 encircles the motor pulley 73 and the greater pulley 72. As the first platen drive motor 71 rotates, the motor pulley 73 is rotated, and the greater pulley 72 is rotated accordingly. The first drive mechanism 7 is provided with a first belt pulley 74, which is attached to the greater pulley 72 to rotate coaxially and in synchronization with the greater pulley 72. The first platen drive motor 71, the motor pulley 73, the greater pulley 72, and the first belt pulley 74 are arranged in the casing 10 in positions lower than a horizontal plane on which the first platen 5 is shifted. Further, a timing belt 78 is provided to encircle the first belt pulley 74 and a second belt pulley 75. The second belt pulley 75 is provided in a position closer to the front of the inkjet printer 1 (i.e., on the left-hand side in FIGS. 1, 4, and 5). A diameter of the second belt pulley 75 is substantially equivalent to a diameter of the first belt pulley 74.

In the inkjet printer 1, the first belt pulley 74 and the second belt pulley 75 are arranged in positions such that a line connecting a rotation axis of the first belt pulley 74 and a center of the second belt pulley 75 is perpendicular to the main scanning direction of the inkjet head 21 (i.e., an axial direction of the guide rail 11), and the timing belt 78 is oriented perpendicularly to the main scanning direction of the inkjet head 21. The timing belt 78 is fixed to the first platen 5 by a platen attachment 51 so that the first platen 5 is shifted in a direction indicated by an arrow A in FIG. 4 (i.e., the auxiliary scanning direction and a front-rear direction of the inkjet printer 1) as the timing belt 78 is shifted in accordance with rotation of the first belt pulley 74. Thus, rotation of the first platen drive motor 71 is conveyed to the motor pulley 73, the motor belt 79, the greater pulley 72, the first belt pulley 74, the timing belt 78, the second belt pulley 75, and the platen attachment 51, and thus converted into horizontal movement to shift the first platen 5 in the auxiliary direction.

Hereinafter, the first platen drive motor 71 according to the present embodiment will be described. The first platen drive motor 71 is a known 1-2 phase-exciting stepping motor, having an electromagnetic stator to surround a rotor. The rotor is attracted to the stator as the stator is excited in an order and rotated. Specifically, the stator has four excitation phases, which are phase A, phase B, phase reverse-A, and phase reverse-B, arranged in a clockwise direction. The stator is excited in an order phase A only, phases A and B, phase B only, phases B and reverse-A, phase reverse-A only, phases reverse-A and reverse-B. As the excited phase is positively polarized in N, the negative (S) pole of the rotor is attracted thereto, and the positive (N) pole of the rotor is repelled. Thus, the rotor is rotated step-by-step.

According to such continuous excitation, the first platen drive motor 71 can be rotated, and the first platen 5 is shifted in the auxiliary direction of the inkjet printer 1. An angle of the rotor to be rotated in one cycle of excitation is determined by a number of the positive poles and the negative poles, and a length of the first platen 5 to be shifted is controlled by a number of the rotating steps of the rotor. In the present embodiment, the second drive mechanism 8 to drive the second platen 6 is configured similarly to the first drive mechanism 7.

Figure 6:
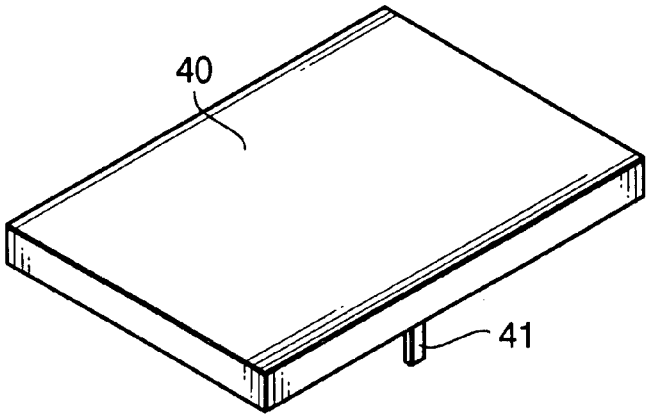
FIG. 6 is a perspective view of an extensible platen according to the first embodiment of the present invention.
Figure 9A:
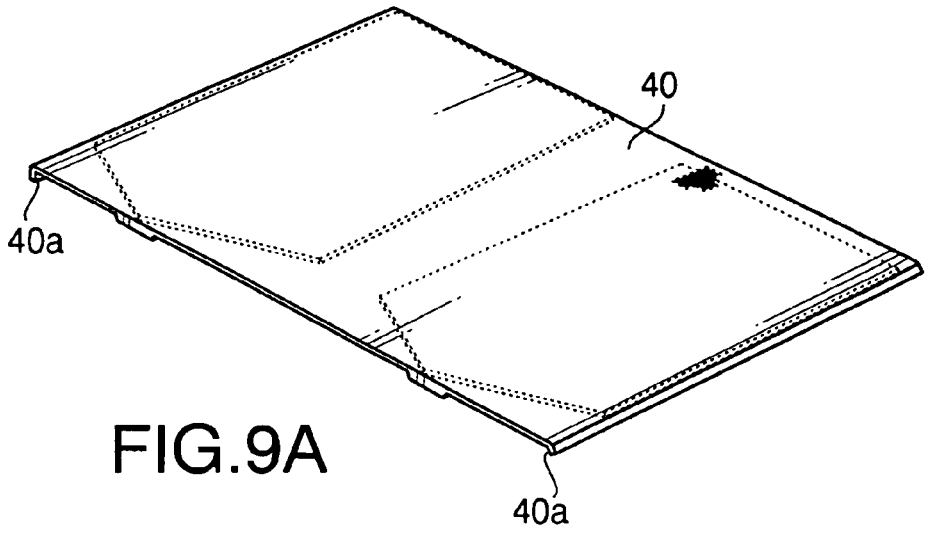
FIG. 9A is a perspective view of the extensible platen to be placed over the first platen and the second platen according to the first embodiment of the present invention.
Figure 9B:
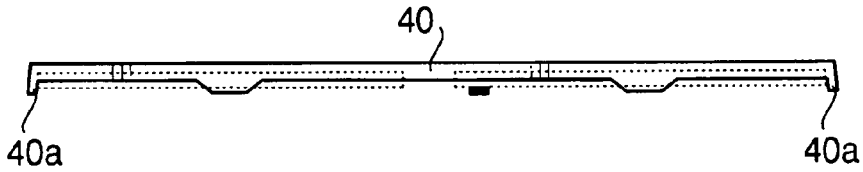
FIG. 9B is an illustrative side view of the extensible platen to be placed over the first platen and the second platen according to the first embodiment of the present invention.
Figure 10:
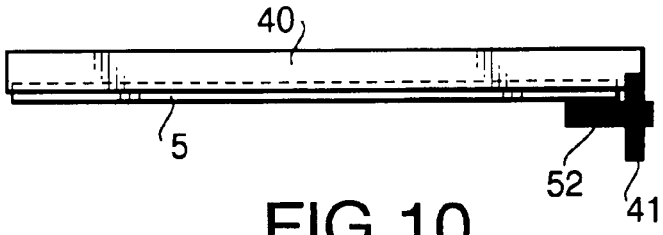
FIG. 10 is an illustrative side view of the first platen with the extensible platen placed over the first platen and the second platen according to the first embodiment of the present invention.
Figure 11:
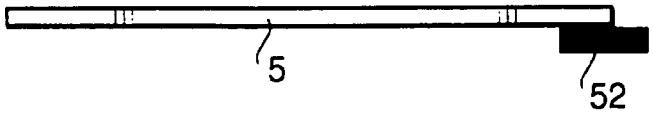
FIG. 11 is an illustrative side view of the first platen without the extensible platen according to the first embodiment of the present invention.

Next, referring to FIGS. 6 to 11, an extensible platen 40 according to the present embodiment will be described. FIG. 6 is a perspective view of the extensible platen 40 according to the embodiment of the present invention. FIG. 7 is a top plane view of the inkjet printer 1 with the extensible platen 40 placed over the first platen 5 and the second platen 6 according to the embodiment of the present invention. FIG. 8 is a front view of the inkjet printer with the extensible platen placed over the first platen and the second platen according to the first embodiment of the present invention. FIG. 9A is a perspective view of the extensible platen to be placed over the first platen and the second platen according to the first embodiment of the present invention, and FIG. 9B is an illustrative side view of the extensible platen to be placed over the first platen and the second platen according to the first embodiment of the present invention. FIG. 10 is an illustrative side view of the first platen 5 with the extensible platen 40 placed over the first platen 5 and the second platen 6 according to the embodiment of the present invention. FIG. 11 is an illustrative side view of the first platen 5 without the extensible platen 40 according to the embodiment of the present invention.

As shown in FIGS. 6, 8, 9A, and 9B, the extensible platen 40 is formed to have a rectangular shape and a size to substantially cover the first platen 5 and the second platen 6. When in use, as shown in FIGS. 7 and 8, the extensible platen 40 is placed over the first platen 5 and the second platen 6 to cover them entirely. The extensible platen 40 is provided with rim portions 40*a* (see FIGS. 9A and 9B), by which one side of the first platen 5 and an opposite side of the second platen (a side symmetrically corresponding to the one side of the first platen 5) are held. Thus, the extensible platen 40 couples the first platen 5 and the second platen 6 integrally. Further, the extensible platen 40 is provided a protrusion 41, made of a light-blocking material, which protrudes downward. The protrusion 41 is inserted in an extensive platen sensor 52, which will be described later, to prevent a photo-receiver (not shown) from receiving light emitted from a light-emitter (not shown). Thus, attachment and detachment of the extensible platen 40 can be detected by the extensible platen sensor 52.

Next, the extensible platen sensor 52 will be described. As shown in FIG. 7, the extensible platen sensor 52, having the light-emitter and the light-receiver, is an optical coupler arranged on the rear side of the first platen 5. As shown in FIGS. 7, 8, and 10, when the extensible platen 40 is placed over the first platen 5 and the second platen 6 to integrally couple them, the protrusion 41 is inserted in between the light-emitter and the light-receiver to block the light emitted from the light-emitter. In this state, the extensible platen sensor 52 is switched on. When the extensible platen 40 is removed from the inkjet printer 1, as shown in FIG. 11, the protrusion 41 between the light-emitter and the light-receiver is removed as well. Thus, the extensible platen sensor 52 is switched off.

Figure 12:
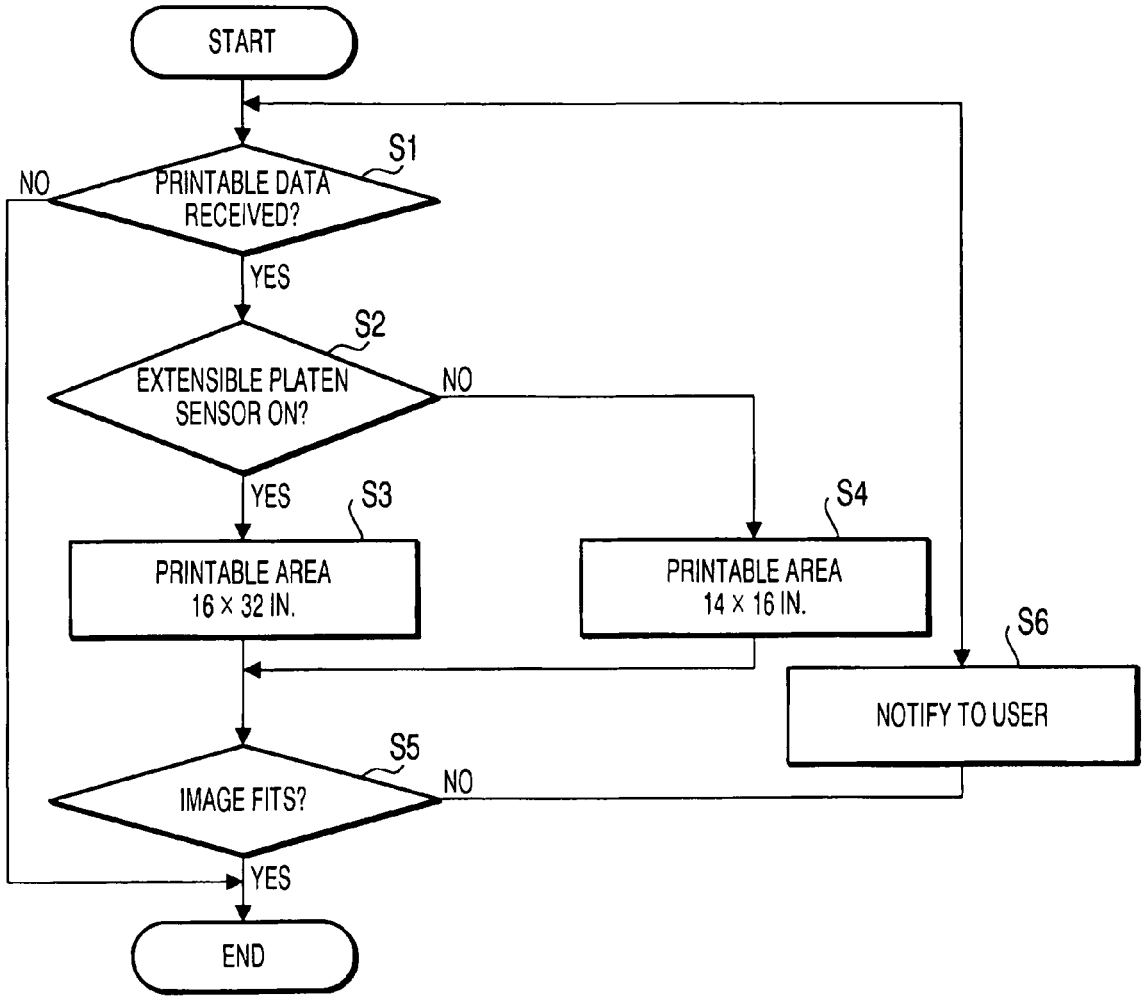
FIG. 12 is a flowchart to illustrate a printable area inspecting process to be executed by a CPU of the inkjet printer according to the first embodiment of the present invention.

Next, referring to FIG. 12, a printable area inspecting process will be described. FIG. 12 is a flowchart to illustrate the printable area inspecting process to be executed by the CPU 110 of the inkjet printer 1 according to the embodiment of the present invention. When the process starts, in S1, it is judged as to whether printable data transmitted from the PC 90 is received in the communication unit 125 through the USB 150. If the printable data is received (S1: YES), in S2, it is judged as to whether the extensible platen sensor 52 is switched on (i.e., the extensible platen 40 is attached). The printable data received in S1 is stored in the RAM 130 (see FIG. 3).

In S2, if it is judged that the extensible platen sensor 52 is switched on (S2: YES) and the extensible platen 40 is attached, in S3, a printable area for the printable data is set according to the size of the extensible platen 40. In the present embodiment, the printable area is set to be 16 inches by 32 inches. The printable area set in S3 is stored in the RAM 130. In S2, if it is judged that the extensible platen sensor 52 is switched off and the extensible platen 40 is not attached (S2: NO), in S4, the printable area is set according to the size of the first platen 5 or the second platen 6. In the present embodiment, the printable area is set to be 14 inches by 16 inches. The printable area set in S4 is stored in the RAM 130. It should be noted that the sizes of the printable area set in S3 and S4 are merely an example and can be determined in advance according to the sizes of the first and second platens 5, 6 and the extensible platen 40.

Following S3 or S4, in S5, an image represented by the printable data store in the RAM 130 can fit in the printable area set in S3 or S4. If it is judged that the image should not fit (S5: NO), in S6, a notification to notify the inconsonance is given to the user through the display 30. If it is judged that the image should fit (S5: YES), the process is terminated.

In S1, when no printable data is received (S1: NO), the process is terminated. The printable area inspecting process is repeated as an interrupting action within an interval of a millisecond time scale to monitor reception of printable data.

Figure 13:
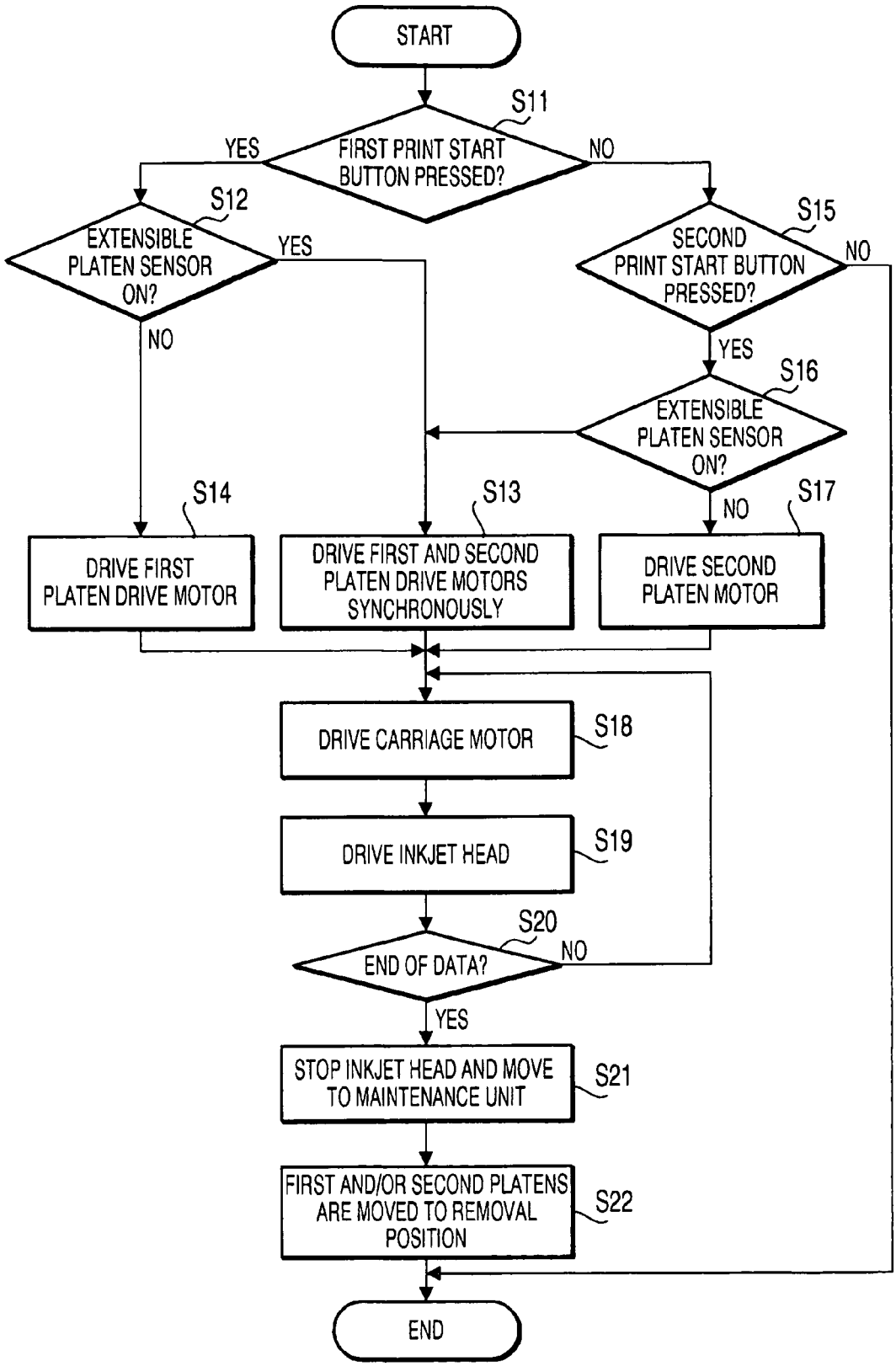
FIG. 13 is a flowchart to illustrate a printing process to be executed by the CPU of the inkjet printer according to the first embodiment of the present invention.

Next, referring to FIG. 13, a printing process to be executed by the CPU 110 of the inkjet printer 1 according to the present embodiment will be described. FIG. 13 is a flowchart to illustrate the printing process according to the embodiment of the present invention. When the process starts, in S11, it is judged as to whether the first print start button 29 is pressed. If it is judged that the first print start button 29 is pressed (S11: YES), in S12, it is judged as to whether the extensible platen sensor 52 is switched on. In S12, if it is judged that the extensible platen sensor 52 is on (i.e., the extensible platen 40 is attached) (S12: YES), in S13, the first platen drive motor 71 and the second platen drive motor 81 are driven synchronously. In this step, the first platen drive motor 71 and the second platen drive motor 81 are driven simultaneously for a same amount in a same direction based on the printable data received in S1 (see FIG. 12). In S12, if it is judged that the extensible platen sensor 52 is switched off (S12: NO), in S14, solely the first platen drive motor 71 is driven based on the printable data received in S1 (FIG. 12).

In S11, if it is judged that the first print start button 29 is not pressed (S11: NO), in S15, it is judged as to whether the second print start button 32 is pressed. In S15, if it is judged that the second print start button 32 is pressed (S15: YES), in S16, it is judged as to whether the extensible platen sensor 52 is switched on. If it is judged that the extensible platen sensor 52 is switched on, i.e., the extensible platen 40 is attached (S16: YES), in S13, the first platen drive motor 71 and the second platen drive motor 81 are driven synchronously. In S16, if it is judged that the extensible platen sensor 52 is switched off (S16: NO), in S17, solely the second platen drive motor 81 is driven based on the printable data received in S1 (FIG. 12).

Following S13, S14, or S17, in S18, the carriage motor 24 is driven, and in S19, the inkjet head 21 is driven based on the printable data received in S1 (FIG. 12). In S20, it is judged as to whether the printable data indicates an end thereof. If it is judged that the printable data remains (S20: NO), the process returns to S18. In S20, if it is judged that the end of the printable data is indicated (S20: YES), the inkjet head 21 is stopped, and in S21, the inkjet head 21 is moved to a position in the maintenance unit. In S22, the first platen 5 and/or the second platen 6 are moved to positions wherein the user can remove the fabric from the first platen 5, the second platen 6, or the extensible platen 40.

Figure 14:
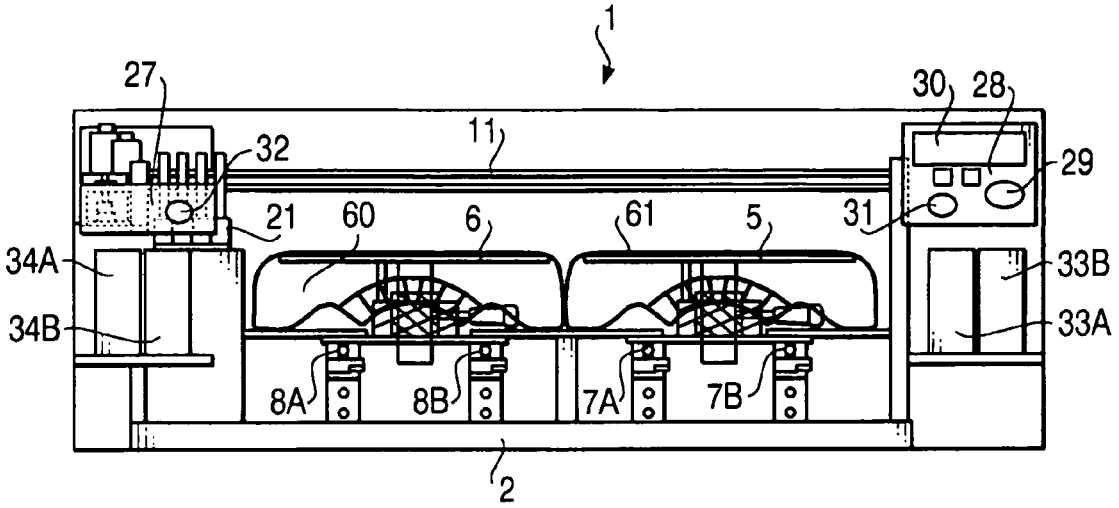
FIG. 14 is a front view of the inkjet printer with recording media over the first platen and the second platen respectively according to the first embodiment of the present invention.
Figure 15:
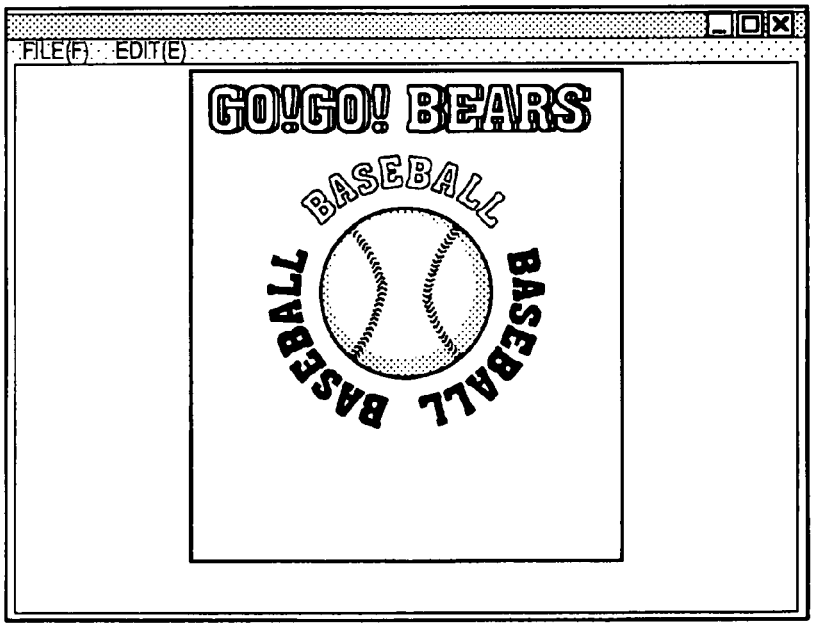
FIG. 15 is an illustrative view of a screen to display an image to be printed by the inkjet printer according to the first embodiment of the present invention.

Next, referring to FIGS. 2, 14, and 15, a configuration of the inkjet printer 1 in which a same image is printed on two pieces of fabrics respectively will be described. FIG. 14 is a front view of the inkjet printer 1 with the T-shirts as the recording media over the first platen 5 and the second platen 6 respectively according to the embodiment of the present invention. FIG. 15 is an illustrative view of a screen to display an image to be printed according to the printable data by the inkjet printer 1 according to the embodiment of the present invention. In the present embodiment, the screen is shown on a display (not shown) of the PC 90. When the same image is printed on two T-shirts 60, 61 respectively, as shown in FIG. 15, printable data representing the image to be printed is created in the PC 90 and transmitted to the inkjet printer 1. In the present embodiment, for example, a size of the image to be printed is 14 inches by 16 inches.

When the extensible platen 40 is not attached over the first and second platens 5, 6, and the first print start button 29 is pressed, the image is printed on the T-shirt 61, which is held by the first platen 5. Thereafter, without the extensible platen 40, when the second print start button 32 is pressed, the image is printed on the T-shirt 60, which is held by the second platen 6. In the above operation, the user is required to create the printable data in the PC 90 solely for the one image to be printed on one of the recording media (i.e., the T-shirts 60, 61) and is not required to prepare a duplicate of the image for the second image to be printed on the T-shirt 61. It is noted that the inkjet printer 1 can be configured such that the operation panel 28 is provided with a simultaneous print start button, which is pressed to start simultaneous printing for the T-shirts 60, 61. In this configuration, when the simultaneous print start button is pressed, the CPU 110 examines as to whether the extensible platen 40 is attached over the first and the second platens 5, 6. If it is judged that the extensible platen 40 is not attached, the first and the second platens 5, 6 are synchronously driven so that the same image can be printed on the T-shirts 60, 61 respectively.

Figure 16:
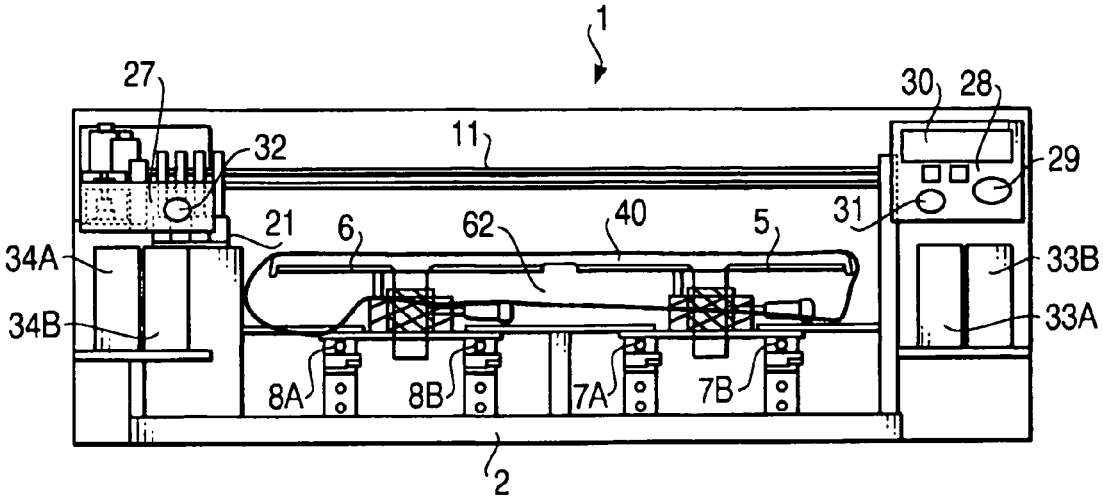
FIG. 16 is a front view of the inkjet printer with a recording medium over the first platen and the second platen according to the first embodiment of the present invention.
Figure 17:
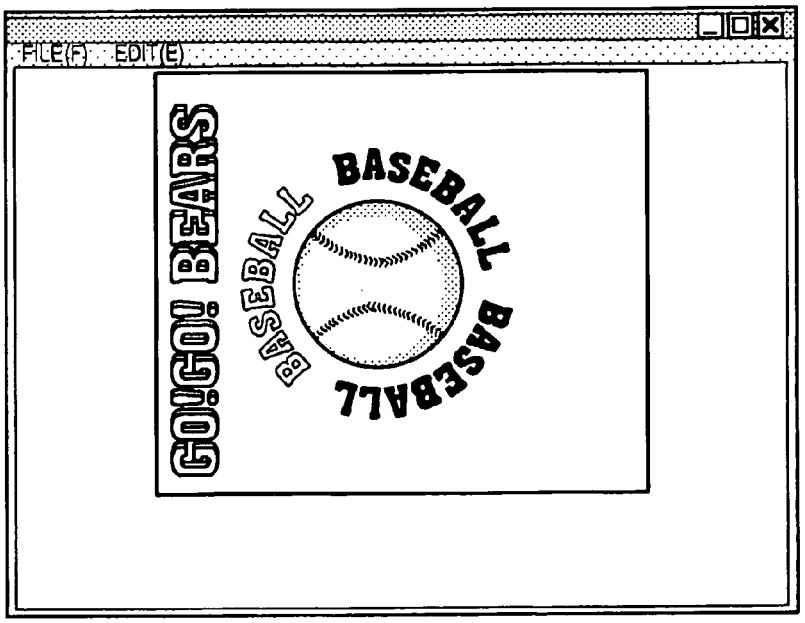
FIG. 17 is an illustrative view of the screen to display a larger image to be printed by the inkjet printer according to the first embodiment of the present invention.

Next, referring to FIGS. 8, 16, and 17, a configuration of the inkjet printer 1 in which a single larger image is printed on one piece of fabric will be described. FIG. 16 is a front view of the inkjet printer 1 with a T-shirt 62 over the first platen 5 and the second platen 6 according to the embodiment of the present invention. FIG. 17 is an illustrative view of a screen to display the larger image to be printed by the inkjet printer 1 according to the embodiment of the present invention. In the present embodiment, the screen is shown on the display of the PC 90. When the larger image is printed on the T-shirt 62, as shown in FIG. 17, printable data representing the larger image to be printed is created in the PC 90 and transmitted to the inkjet printer 1. In the present embodiment, for example, a size of the larger image to be printed is 16 inches by 32 inches. When the larger image is printed, as shown in FIG. 8, the extensible platen 40 is placed over the first platen 5 and the second platen 6, and the T-shirt 62 is laid over the extensible platen 40 as shown in FIG. 16. Thus, the larger image, which has a size of 16 inches by 32 inches in the present embodiment, can be printed on a larger printable area. It is noted that in this configuration, as shown in FIG. 16, the T-shirt 62 is placed over the extensible platen 40 with its longitudinal center line (i.e., a vertical center line when the T-shirt 62 is worn) oriented parallel with the main scanning direction in the inkjet printer 1, while the T-shirts 60, 61 are placed over the first platen 5 and the second platen 6 respectively with the longitudinal center lines thereof being perpendicular to the main scanning direction. Therefore, as shown in FIG. 17, the larger image shown in the screen is rotated at 90 degrees to the left so that the larger image can be printed on the T-shirt 62 in a correct orientation.

Figure 18:
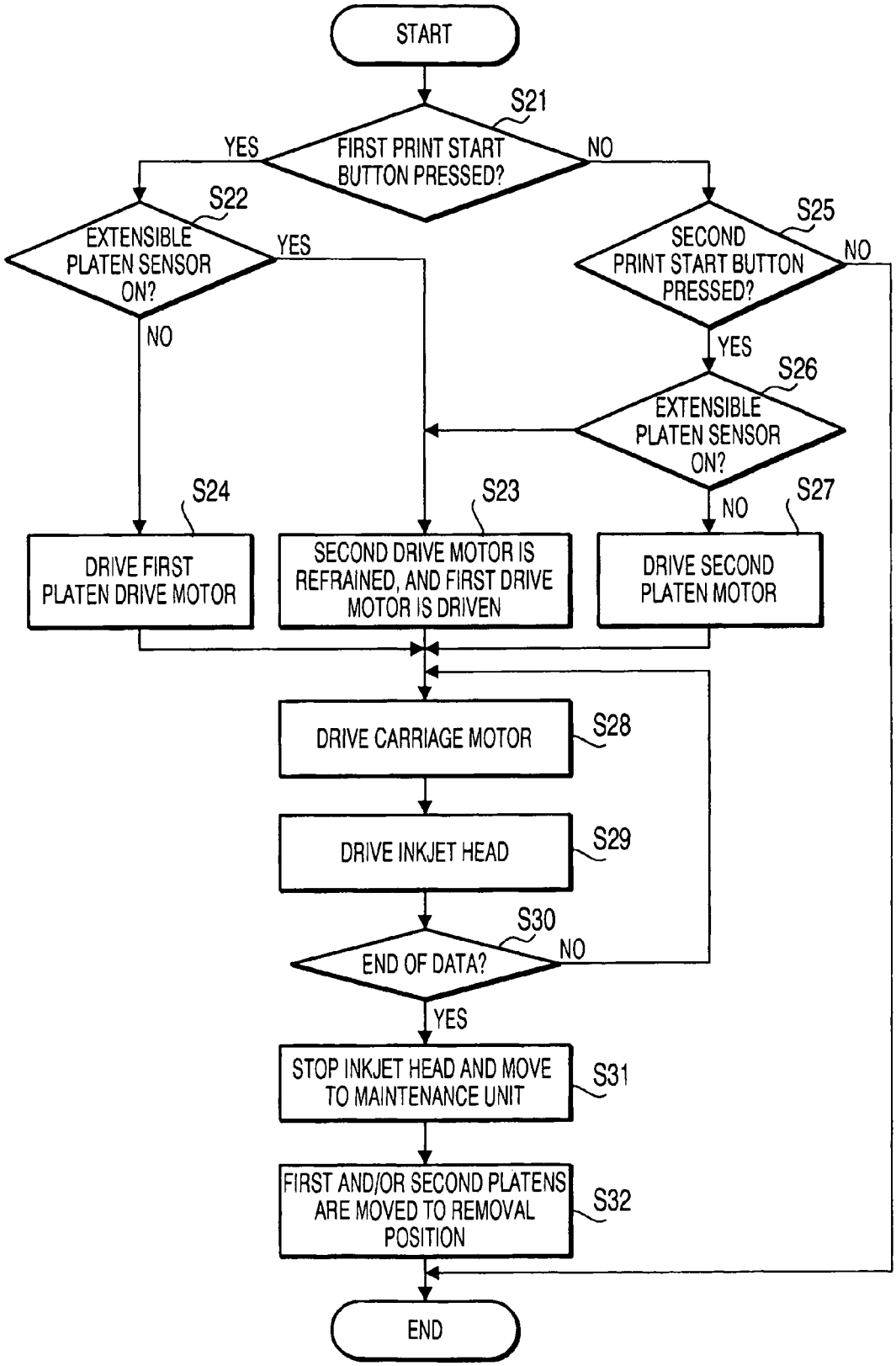
FIG. 18 is a flowchart to illustrate a printing process according to a second embodiment of the present invention.

Next, referring to FIG. 18, a printing process to be executed by the CPU 110 of the inkjet printer 1 according to a second embodiment of the present invention will be described. In the present embodiment, a configuration of the inkjet printer identical to the configuration of the inkjet printer 1 in the first embodiment is referred to by an identical reference numeral, and description of that will be omitted. FIG. 18 is a flowchart to illustrate the printing process according to the second embodiment of the present invention. In the present embodiment, the first platen drive motor 71 is configured to have substantial power to drive the first platen 5 and the second platen 6 with a extensible platen 40 thereonto so that the first platen 5 along with the second platen 6 and the extensible platen 40 with the T-shirt 62 can be driven solely by the first platen drive motor 71. When the second platen 6 and the extensible platen 40 are driven along with the first platen 5 are driven by the first platen drive motor 71, excitation to the second platen drive motor 81 is refrained. Meanwhile, the second platen drive motor 81 can be configured to have power to drive solely the second platen 6.

When the process starts, in S21, it is judged as to whether the first print start button 29 is pressed. If it is judged that the first print start button 29 is pressed (S21: YES), in S22, it is judged as to whether the extensible platen sensor 52 is switched on. In S22, if it is judged that the extensible platen sensor 52 is switched on (i.e., the extensible platen 40 is attached) (S22: YES), in S23, the second platen drive motor 81 is refrained from being excited, and solely the first platen drive motor 71 is driven based on the printable data received in S1 (FIG. 12). In S22, if it is judged that the extensible platen sensor 52 is switched off (S22: NO), in S24, the first platen drive motor 71 is driven based on the printable data received in S1 (FIG. 12).

In S21, if it is judged that the first print start button 29 is not pressed (S21: NO), in S25, it is judged as to whether the second print start button 32 is pressed. In S25, if it is judged that the second print start button 32 is pressed (S25: YES), in S26, it is judged as to whether the extensible platen sensor 52 is switched on. If it is judged that the extensible platen sensor 52 is switched on, i.e., the extensible platen 40 is attached (S26: YES), in S23, the second platen drive motor 81 is refrained from being excited, and solely the first platen drive motor 71 is driven based on the printable data received in S1 (FIG. 12). In S26, if it is judged that the extensible platen sensor 52 is switched off (S26: NO), in S27, solely the second platen drive motor 81 is driven based on the printable data received in S1 (FIG. 12).

Following S23, S24, or S27, in S28, the carriage motor 24 is driven, and in S29, the inkjet head 21 is driven based on the printable data received in S1 (FIG. 12). In S30, it is judged as to whether the printable data indicates an end thereof. If it is judged that the printable data remains (S30: NO), the process returns to S28. In S30, if it is judged that the end of the printable data is indicated (S30: YES), the inkjet head 21 is stopped, and in S31, the inkjet head 21 is moved to a position in the maintenance unit. In S32, the first platen 5 and the second platen 6 are moved to positions wherein the user can remove the fabric from the first platen 5, the second platen 6, or the extensible platen 40.

As has been described above, the inkjet printer 1 according to the above embodiments is provided with the first platen 5, the second platen 6, and the extensible platen 40 which can be attached over the first platen 5 and the second platen 6. With the extensible platen 40 being attached over the first platen 5 and the second platen 6, a larger printable area than the printable areas provided by one of the first platen 5 and the second platen 6 can be provided. In addition, with the extensible platen sensor 52, the first platen 5 and the second platen 6 can be driven synchronously (with or without excitation of the second platen drive motor 81) when the extensible platen 40 attached over the first platen 5 and the second platen 6 is detected. Meanwhile, when the extensible platen 40 is not detected by the extensible platen sensor 52, the first platen 5 and the second platen 6 can be separately driven. In this configuration, the printable area can be enlarged according to the size of the extensible platen 40 by attaching the extensible platen 40 in the inkjet printer 1. Further, a same image can be printed on a plurality of pieces of fabrics by simply creating one image and transmitting the image to the inkjet printer 1 without the extensible platen 40. Thus, platens to suitably hold the recording media can be used according to the size of the image and the size of the recording medium so that printing time and productivity to print the image can be optimized.

Although examples of carrying out the invention have been described, those skilled in the art will appreciate that there are numerous variations and permutations of the printing apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

Figure 19:
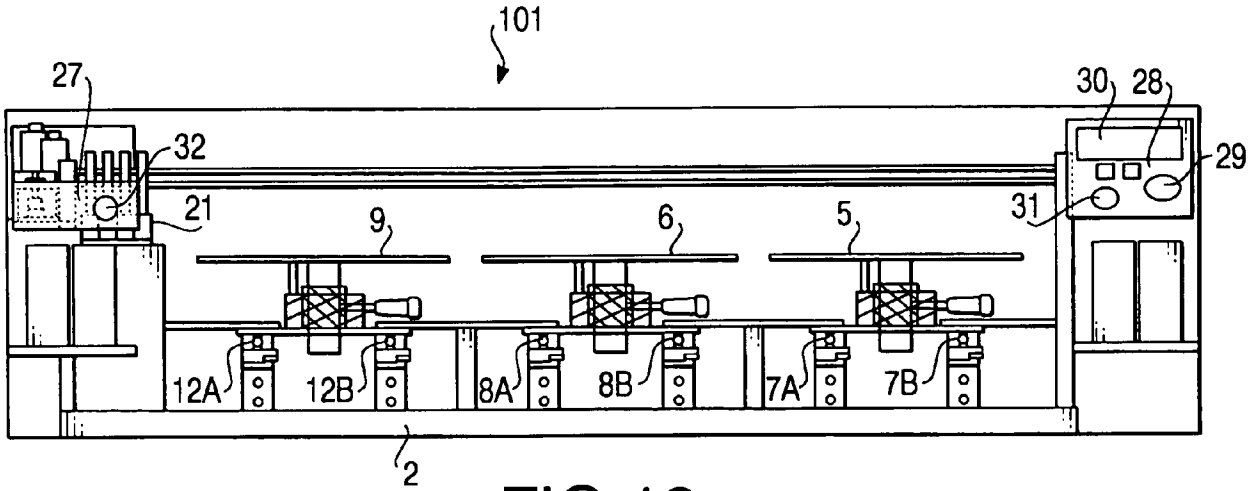
FIG. 19 is a front view of an inkjet printer with a third platen in addition to the first platen and the second platen according to a third embodiment of the present invention.

For example, the extensible platen sensor 52 can be provided to the second platen 6 rather than the first platen 5. Further, a third platen 9 formed identically to the first platen 5 and the second platen 6 can be provided (see FIG. 19). FIG. 19 is a front view of an inkjet printer 101 with the third platen 9 in addition to the first platen 5 and the second platen 6 according to a third embodiment of the present invention. In the inkjet printer 101, the third platen 9 is guided by the guide rails 12A, 12B and driven by a third platen drive motor (not shown).

Figure 20:
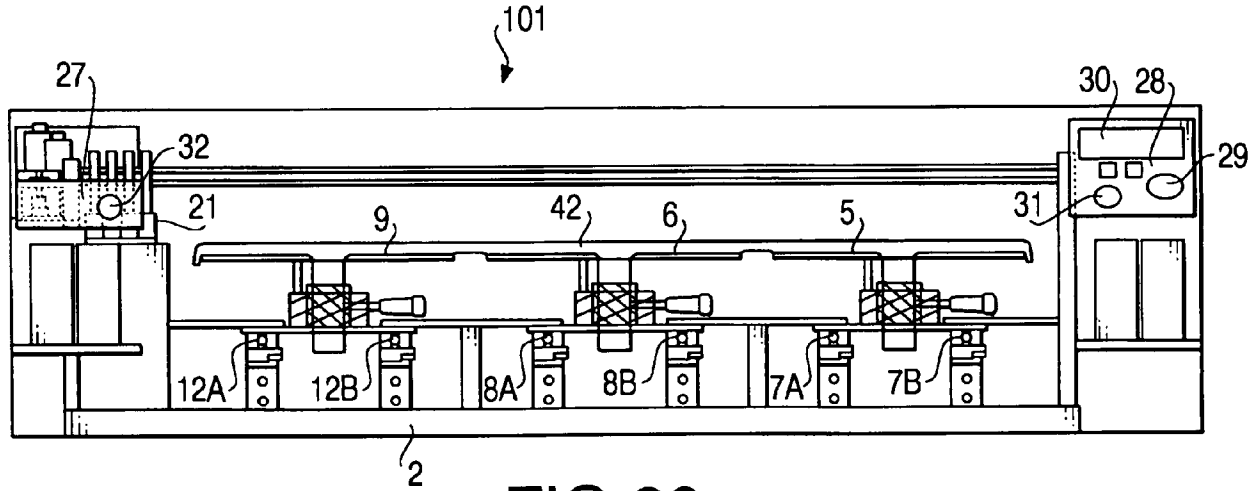
FIG. 20 is a front view of the inkjet printer with a larger-seized extensible platen placed over the first platen, the second platen, and the third platen according to the third embodiment of the present invention.
Figure 21:
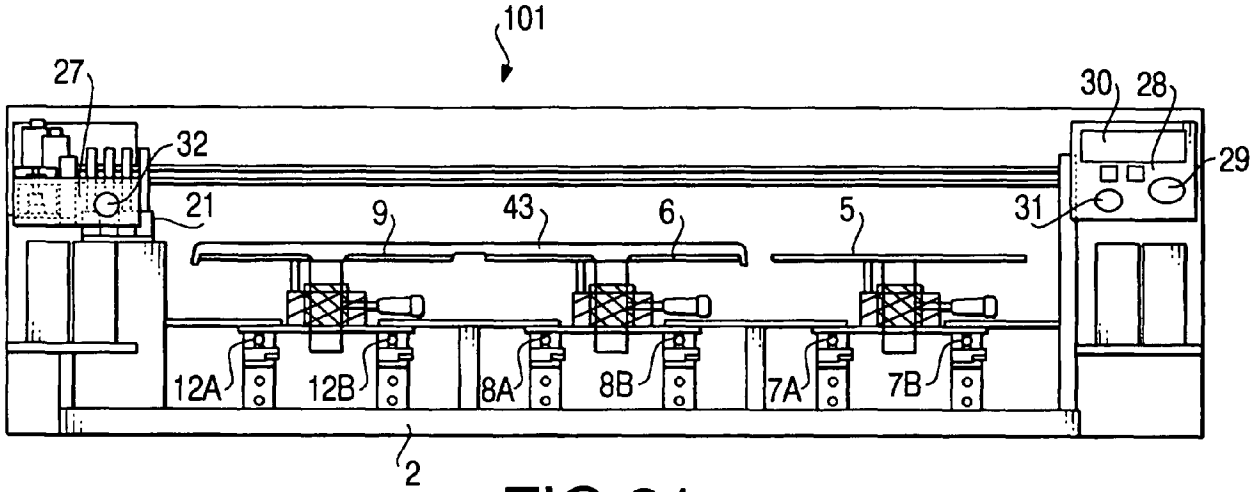
FIG. 21 is a front view of the inkjet printer with an extensible platen placed over the second platen and the third platen according to the third embodiment of the present invention.
Figure 22:
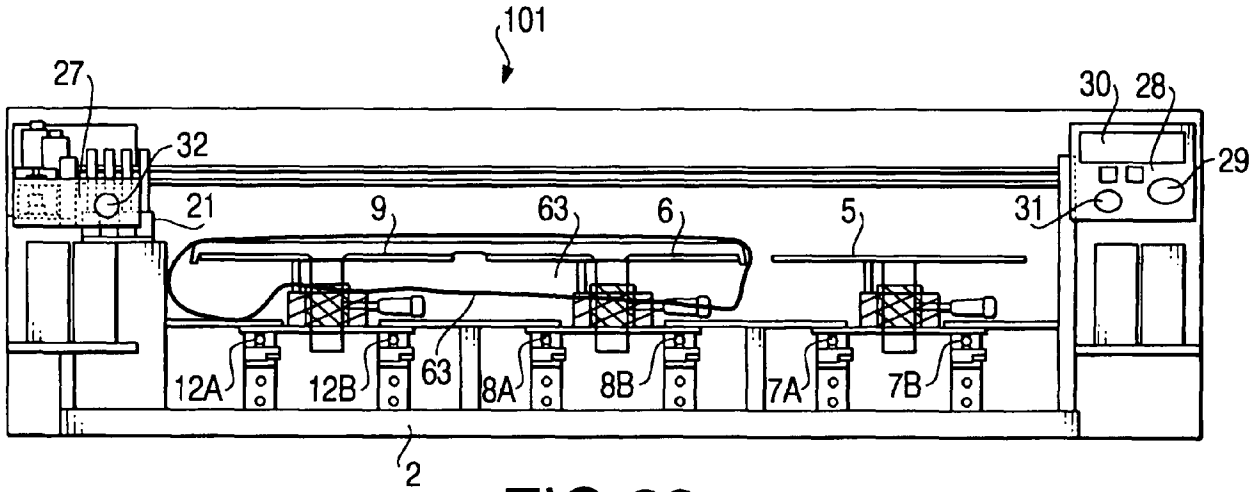
FIG. 22 is a front view of the inkjet printer with a recording medium over the extensible platen covering the second platen and the third platen according to the third embodiment of the present invention.
Figure 23:
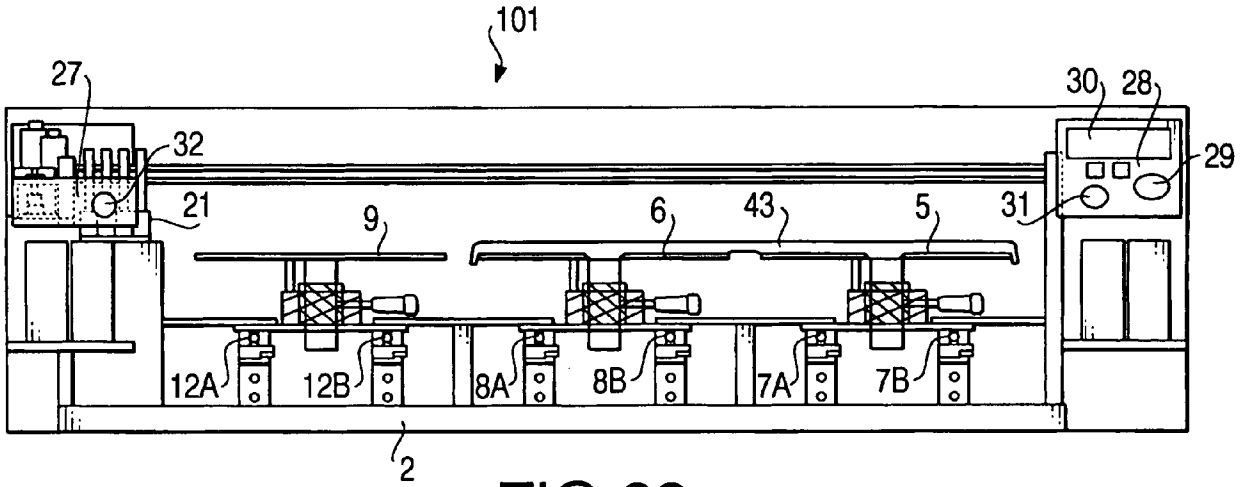
FIG. 23 is a front view of the inkjet printer with the recording medium over the extensible platen covering the first platen and the second platen according to the third embodiment of the present invention.
Figure 24:
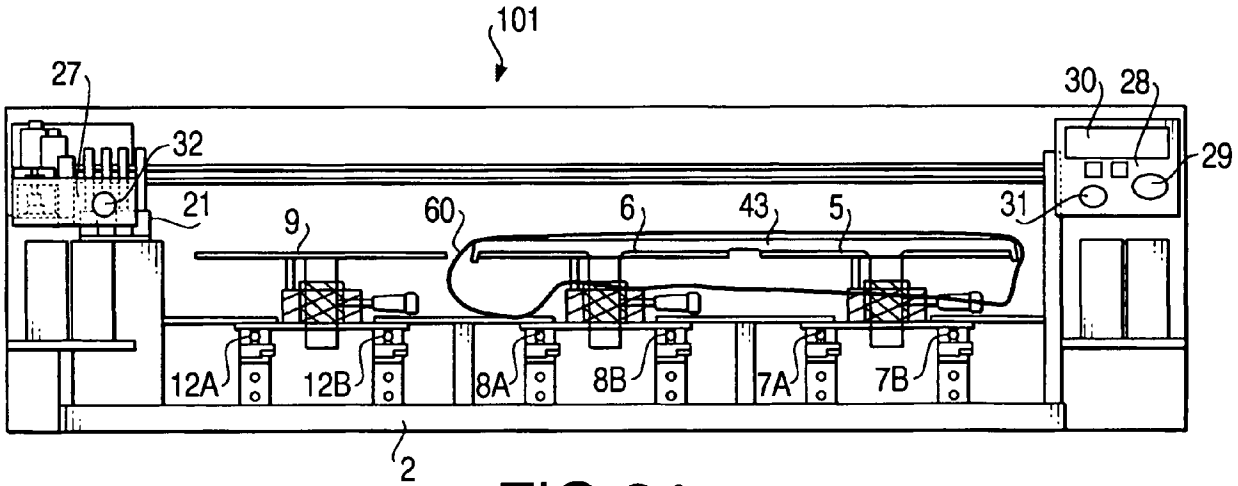
FIG. 24 is a front view of the inkjet printer with the recording medium over the extensible platen covering the first platen and the second platen according to the third embodiment of the present invention.

In the inkjet printer 101, a larger-sized extensible platen 42 which covers the first platen 5, the second platen 6, and the third platen 9 can be attached so that a larger printable area can be provided (see FIG. 20). FIG. 20 is a front view of the inkjet printer 101 with the larger-seized extensible platen 42 placed over the first platen 5, the second platen 6, and the third platen 9 according to the third embodiment of the present invention. Further, the inkjet printer 101 can be provided with an extensible platen 43, which can cover two of the three platens 5, 6, 9. FIG. 21 is a front view of the inkjet printer 101 with the extensible platen 43 placed over the second platen 6 and the third platen 9 according to the third embodiment of the present invention. In this configuration, a T-shirt 63 can be held by the extensible platen 43 which is placed over the second platen 6 and the third platen 9 (see FIG. 22). FIG. 22 is a front view of the inkjet printer 101 with the T-shirt 63 over the extensible platen 43 covering the second platen 6 and the third platen 9 according to the third embodiment of the present invention. However, the extensible platen 43 can be attached over the first platen 5 and the second platen 6 (see FIG. 23). FIG. 23 is a front view of the inkjet printer 101 with the T-shirt 63 over the extensible platen 43 covering the first platen 5 and the second platen 6 according to the third embodiment of the present invention. In this configuration, the T-shirt 63 can be held by the extensible platen 43 which is placed over the first platen 5 and the second platen 6 (see FIG. 24). FIG. 24 is a front view of the inkjet printer 101 with the T-shirt 63 over the extensible platen 43 covering the first platen 5 and the second platen 6 according to the third embodiment of the present invention.

In the inkjet printer 101 in the third embodiment, the extensible platen sensor 52 can be provided to each of the first platen 5, the second platen 6, and the third platen 9. Meanwhile, the extensible platen 42 can be provided with three protrusions 41, which are inserted into each of the extensible platen sensors 52 provided to the first platen 5, the second platen 6, and the third platen 9. The extensible platen 43 can be provided with two protrusions 41, which are inserted into two of the extensible platen sensors 52 provided to the first platen 5, the second platen 6, and the third platen 9. With this configuration, the print controlling unit 100 of the inkjet printer 101 can determine which extensible platen between the extensible platen 42 and the extensible platen 43 is attached. Similarly, the number of the platens can be arbitrarily increased.

What is claimed is:

1. A printing apparatus capable of forming an image on a recording medium, comprising:

a recording head to eject ink onto the recording medium;

a recording head controller to control movement of the recording head according to printing data, which represents the image to be formed on the recording medium;

a carriage to carry the recording head in a main scanning direction relative to the recording medium;

a plurality of platens, each of which has a holding surface to hold the recording medium thereon and is movable respectively in an auxiliary direction, which is perpendicular to the main scanning direction;

a plurality of drive mechanisms, each of which drives one of the platens in the auxiliary direction;

a synchronization controller that is configured to control the plurality of drive mechanisms and manipulate the plurality of platens to be moved for a same amount in a same direction simultaneously; and an extensible table, which is detachably attached over at least two of the platens;

wherein the plurality of platens can be moved synchronously with one another.

2. The printing apparatus according to claim 1, further comprising:

a detecting unit to detect presence of the extensible table being attached over the at least two of the platens, wherein the detecting unit includes a detectable portion, which is provided the extensible table, and a detector, which is provided to one of the at least two of the platens to detect the detectable portion when the extensible table is attached over the at least two of the platens.

3. The printing apparatus according to claim 2, wherein the synchronization controller controls drive mechanisms of the at least two of the platens when the detector detects the detectable portion of the extensible table being attached over the at least two of the platens.

4. The printing apparatus according to claim 3, further comprising:

a printable size judging system to judge a size of a printable area, in which the image is formed, according to a size of the extensible table when the presence the extensible table being attached over the at least two of the platens is detected by the detecting unit.

5. The printing apparatus according to claim 3, further comprising:

a printable size judging system to judge a size of a printable area, in which the image is formed, according to a size of the plurality of platens when absence of the extensible platen is detected by the detecting unit.

6. The printing apparatus according to claim 2, wherein the extensible table has a size to substantially include the at least two of the platens.

7. The printing apparatus according to claim 1, wherein the extensible table couples at least two of the platens so that the at least two of the platens are moved in synchronization with each other.

8. The printing apparatus according to claim 7, wherein a drive mechanism of one of the at least two platens being coupled by the extensible table is capable of driving the at least two platens being coupled and the extensible table.

9. The printing apparatus according to claim 1, wherein the extensible table has a size to substantially include the at least two of the platens.

10. The printing apparatus according to claim 1, further comprising:

a detecting unit to detect presence of the extensible table being attached over the at least two of the platens; and a printable size setting system to judge a size of a printable area, in which the image is formed, according to a size of the extensible table when the presence the extensible table being attached over the at least two of the platens is detected by the detecting unit.

11. The printing apparatus according to claim 1, further comprising:

a detecting unit to detect presence of the extensible table being attached over the at least two of the platens; and a printable size judging system to judge a size of a printable area, in which the image is formed, according to a size of the plurality of platens when absence of the extensible platen is detected by the detecting unit.

12. The printing apparatus according to claim 1, further comprising:

a detecting unit to detect presence of the extensible table being attached over the at least two of the platens, wherein the detecting unit includes a detectable portion, which is provided the extensible table, and a detector, which is provided to one of the at least two of the platens to detect the detectable portion when the extensible table is attached over the at least two of the platens; and wherein the plurality of drive mechanisms drive the at least two of the platens being coupled by the extensible table synchronously when the detector detects the detectable portion of the extensible table.

13. The printing apparatus according to claim 12, wherein at least one of the drive mechanisms drives the at least two of the platens being coupled by the extensible table when the detector detects the detectable portion of the extensible table.

14. The printing apparatus according to claim 1, wherein the extensible table has a holding surface being greater than the holding surface of the respective platens, and wherein a printable area, in which the image can be formed, can be extended by the extensible table being attached over the at least two of the platens.

* * * * *